US005259220A

United States Patent [19]

Fredrickson

[11] Patent Number: 5,259,220

[45] Date of Patent: Nov. 9, 1993

[54] SECURITY DEVICE FOR MERCHANDISE DISPLAY HOOKS

[76] Inventor: Howard J. Fredrickson, Box 131 - R.R. 4, Cannon Falls, Minn. 55009

[21] Appl. No.: 883,468

[22] Filed: May 15, 1992

[51] Int. Cl.[5] ..... E05B 73/00

[52] U.S. Cl. ..... 70/14; 70/46; 70/52; 211/7; 211/59.1

[58] Field of Search ..... 70/18, 46, 52, 61, 62, 70/199; 211/7, 57.1, 59.1

[56] References Cited

U.S. PATENT DOCUMENTS

| | | | |
|---|---|---|---|
| 53,096 | 3/1866 | Ascherfeld | 70/55 |
| 327,184 | 9/1885 | McDougall | 70/46 |
| 1,127,213 | 2/1915 | Erichson | 70/46 |
| 1,475,863 | 11/1923 | Pate | 70/199 |
| 1,609,817 | 12/1926 | Hanton | 70/46 |
| 1,644,155 | 10/1927 | Scott | 211/59.1 X |
| 1,718,723 | 6/1929 | Williams | 70/18 |
| 2,119,217 | 5/1938 | Rocchi | 70/61 X |
| 3,655,061 | 4/1972 | Peschcke-Koedt | 211/57 |
| 3,690,130 | 9/1972 | Eutzler | 70/18 |
| 3,835,676 | 9/1974 | Foote | 70/52 |
| 4,155,458 | 5/1979 | Moline | 211/59.1 X |
| 4,289,242 | 9/1981 | Kenyon | 211/4 |
| 4,394,909 | 7/1983 | Valiulis et al. | 211/59.1 |
| 4,474,300 | 10/1984 | Entis | 211/57.1 |
| 4,697,441 | 10/1987 | Allen | 70/18 X |
| 4,889,304 | 12/1989 | Glickman et al. | 248/222.1 |
| 4,976,058 | 12/1990 | Valiulis | 40/657 |
| 5,027,622 | 7/1991 | Hatch et al. | 70/14 |
| 5,103,984 | 4/1992 | Leyden et al. | 211/7 |

FOREIGN PATENT DOCUMENTS

| | | | |
|---|---|---|---|
| 614789 | 2/1961 | Canada | 211/7 |

*Primary Examiner*—Lloyd A. Gall

*Attorney, Agent, or Firm*—Jacobson and Johnson

[57] ABSTRACT

As a security device to prevent unauthorized removal of merchandise carried by rigid rods cantilevered to a support member, such as conventional pegboard display hooks, a rigid platelike assembly has open end slots along one edge for engaging the display hooks and the ends of the slots can be closed off by a pivotable locking arm to hold the security device on the hooks and prevent the security device from being disengaged from the hooks by sliding off the end of the hooks. The locking arm is latched in the closed or locking position but is releasable by operation of a key to disengage the security device to be able to remove merchandise from the display hook. As a feature, a space is provided on the security device for attaching a label carrying information about the merchandise.

8 Claims, 3 Drawing Sheets

SECURITY DEVICE FOR MERCHANDISE DISPLAY HOOKS

FIELD OF THE INVENTION

This invention is directed toward providing security against the pilfering of merchandise which is hung and displayed on rods which are cantilevered to a support such as what is commonly known as pegboard-type hooks. More particularly, the invention is directed toward a key-releasable plate-like assembly security device for preventing removal of merchandise by slipping it off the end of the display hook without authorization.

DESCRIPTION OF THE PRIOR ART

U.S. Pat. No. 4,889,304 illustrates a display hook which is an example of the type of display hook with which the present invention is concerned. The '304 patent is directed toward securing the cantilevered hook to its pegboard support. The '304 patent also shows a spherical enlarging element at the distal end of a display hook which is there for safety reasons.

U.S. Pat. No. 4,394,909 shows a cantilevered display hook with a cantilevered arm extending over the hook from the pegboard, or other support, to protect the hook from being struck accidentally. The arm has a flat surface over the distal end of the hook which can be used to hold a price sticker or label or the like.

U.S. Pat. No. 4,976,058 is directed towards a protector and label-holder similar to the '909 patent.

U.S. Pat. No. 5,027,622 provides a key-operated locking device for a pegboard-style hook having a bent distal end in the form of a block having an elongated open-end groove for engaging the hook member and a closure or cover to close off the open end of the groove to prevent the hook from being removed from the groove out the open end. The closed off groove is made long enough so that the block will bind on the hook if an effort is made to slip it off the distal end of the hook. The cover can be opened by operation of a key in order to remove the security device so that merchandise can be removed from the hook. The size of the elongated opening in the block formed by the closed off groove cannot be altered to accommodate hooks of different diameters. Also, this device will not work with double rod display hooks.

SUMMARY OF THE INVENTION

A relatively thin, rigid, plate-like assembly has front and back spaced-apart plates with open end slots on the top edge of the plates for engaging cantilevered rigid rods, such as pegboard display hooks, and a locking arm which is pivotably attached between the plates which can be swung to close off the open end of the slots to hold the plate assembly on the rods and to prevent the plate-like assembly from being slid off the end of the rod when the locking arm is in the closed position. The locking arm is held closed by a latch which is releasable by a manually operated key so the arm can be opened to remove the device from the display rod to allow merchandise to be removed. The latch is provided with multiple positions so that the arm can be swung to close the slots to different sizes to accommodate rods or hooks of different diameters. Preferably the plate-like assembly is constructed in the form of a rectangular-shaped disc and has three slots along an edge so it can be used interchangeably as a security device for a single-rod hook or for a double-rod hook. The security device can be in other shapes or forms such as a circular or oval disc.

DESCRIPTION OF THE PREFERRED EMBODIMENTS

Figure 1:
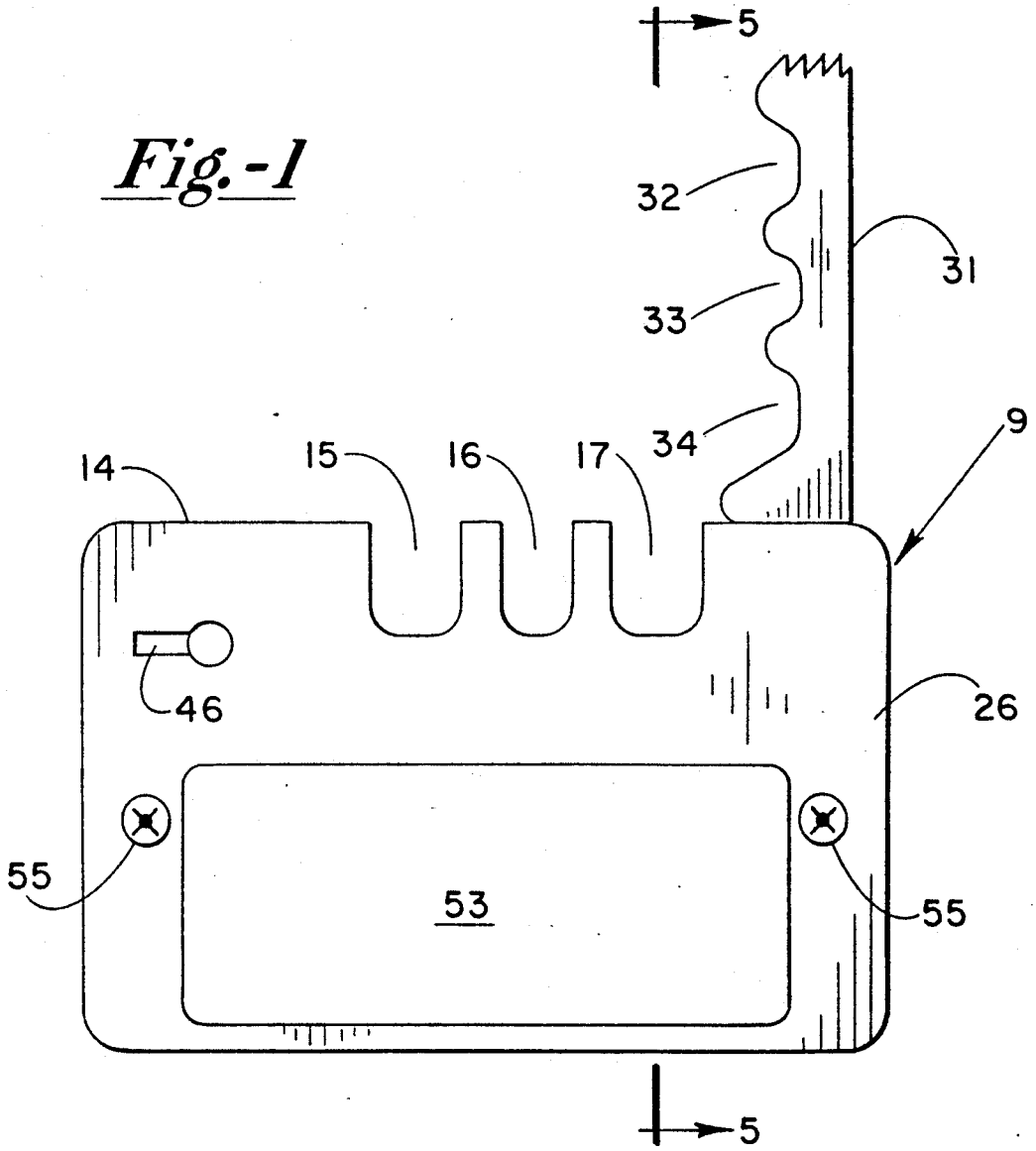
FIG. 1 is a front plan view of a preferred embodiment of the invention.

The preferred form of the security device is a rectangular-shaped plate or disc assembly, identified generally by reference numeral 9, comprising a main body member 10 having a back wall or plate 11 surrounded by relatively narrow right side wall 12A, left side wall 12B and bottom wall 12C which define an interior shallow recess or chamber generally designated by reference numeral 13. Chamber 13 is closed by a front cover plate 26 which is parallel to back plate 11 and attached by screws 55 in threaded openings on pads 27 and 28. Laterally spaced slots 15, 16 and 17 having open top ends are cut out along the top edges 14 of back wall plate 11 and cover plate 26.

Figure 2:
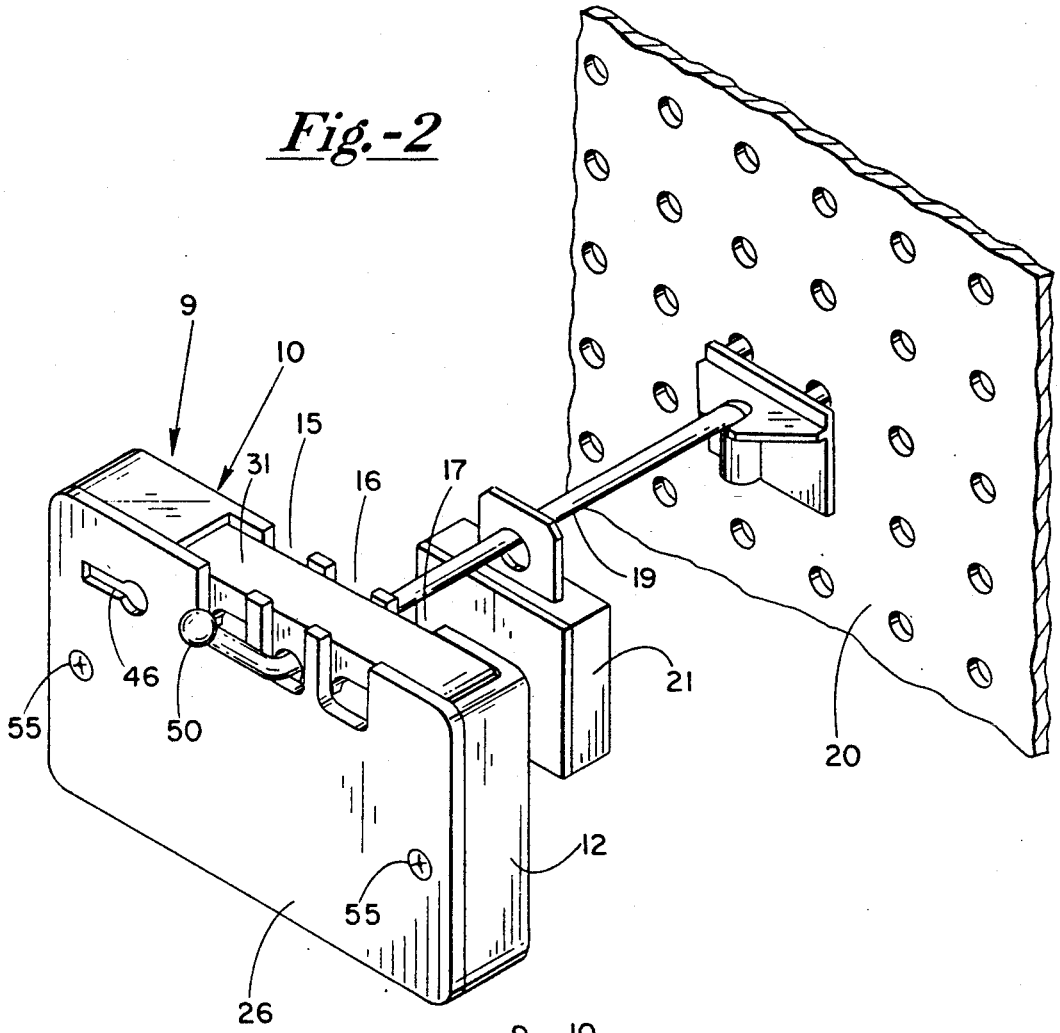
FIG. 2 is a perspective view illustrating a preferred embodiment of the invention mounted on a single-rod display hook.
Figure 3:
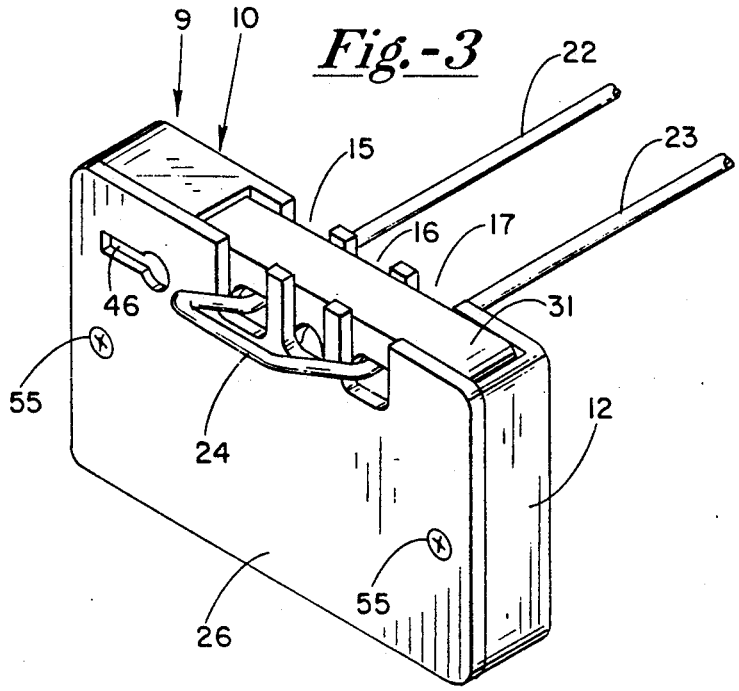
FIG. 3 is a perspective view illustrating the preferred embodiment mounted on a double-rod display hook.

Typically and conventionally an elongated rigid rod 19 which, for example, may be made out of plastic or metal, is attached at one end to a pegboard 20, or to some other type of support, and extends in a cantilevered fashion from support 20 as a display hook for carrying packaged merchandise, such as illustrated at 21, hung by a suitable opening in the package. Towards its distal end hook or rod 19 is angled upward to prevent merchandise from accidentally slipping off and may also have a ball 50 at the end for safety. Ordinarily, the merchandise is removed from display hook 19 by slipping it off the distal end of hook 19. Another common design for a display hook comprises a pair of laterally spaced rods 22 and 23 which are attached at one end in some fashion to a supporting pegboard or other support (not shown) and extend in a cantilevered fashion from the support to form a double-rod display hook with the merchandise (not shown in FIG. 3) hung from rods 22 and 23 by a large opening at the top of the package. Typically and conventionally the ends of rods 22 and 23 are joined or connected together as illustrated at 24 and merchandise is removed by slipping the package off the end. As illustrated in FIGS. 2 and 3, outer slots 15 and 17 at the top edge of plate assembly 9 are used to receive rods 23 and 22 of the doublerod display hook 22, 23 and middle or inner slot 16 is used for receiving the single-rod display hook 19.

Figure 4:
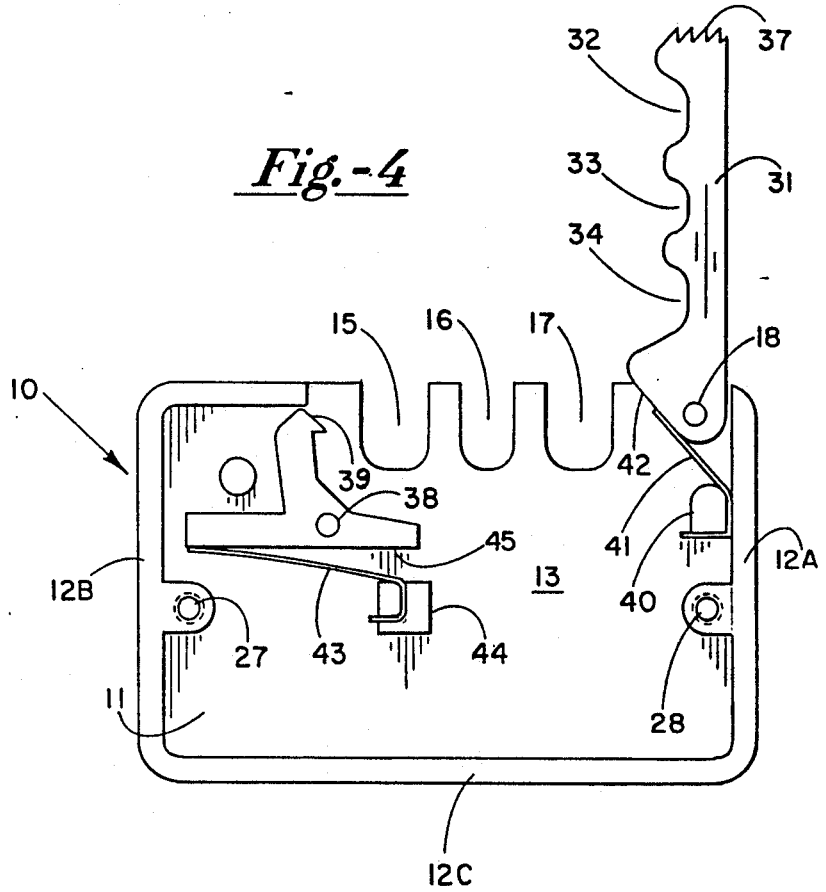
FIG. 4 is a view with the front plate member removed showing the locking and release mechanisms utilized in the preferred embodiment.

Pivotably mounted at pivot point 18 to body member 10 between front and back plates 26 and 11 is locking arm 31 which has shallow grooves or slots 32, 33 and 34 along one side. Arm 31 is illustrated in the open position in FIGS. 1 and 4. When swung counterclockwise or downwardly, as observed in FIGS. 1 and 4, towards the top edge 14 of plate assembly 9, slots 32, 33 and 34 in arm 31 generally coincide with slots 15, 16 and 17, respectively, so that arm 31 closes off the open ends of slots 15, 16 and 17 to form closed openings or passageways through the plate assembly for engaging the hooks or rods, as illustrated in FIGS. 2 and 3. When hook or rod 19 is placed into slot 16 through its open end, and/or rods 22 and 23 inserted through the open end into slots 15 and 17, and arm 31 is closed, the security device 9 hangs downward and is supported by arm 31 resting on the rods. Arm 31 can be used to narrow or restrict the size of the opening or passageway that enclose rod 19 so that the security device (and therefore the merchandise) cannot be slipped off rod 19 over the angled and/or balled end. In the case of the double rod hook, the end connection 24 prevents the security device from slipping off the end.

On the distal end of arm 31 is a set of serrations or teeth 37. Pivotably attached at 38 to body member 10 is an arm 45 having a general shape of an upside down T, with a hook or pawl 39 at the end of the vertical leg of the T for engaging teeth 37 of locking arm 31. Mounted part way around pad 40 in the recess of body member 10 is elongated bent flat spring 41 which is arranged to resiliently push against an angled or slanted surface 42 of arm 31 to urge arm 31 to pivotally swing in a clockwise or upwardly direction (as observed in FIG. 4) to its open position. Another similar flat spring 43 is mounted and curved part way around pad 44 within the recess of member 10 and is arranged to provide a resilient force against pawl arm 45 toward the end of a horizontal leg of the T to move arm 45 in a direction urging pawl or hook 39 into engagement with teeth 37 of arm 31 when arm 31 is closed. When rods 22 and 23 and/or rod 19 are resting in slots 15 and 17 and/or slot 16, locking arm 31 is swung closed to close off the top open end of slots 15, 16 and 17 and arm 31 is latched in the closed position by pawl 39 engaging one of the set of teeth 37. To open arm 31 so that the security device can be removed, a key, generally designated by reference numeral 51, is inserted into slot 46 in cover plate 26 and key 51 is rotated in a direction so that finger 52 of key 51 contacts pawl arm 45 and forces it in a direction opposite the force of spring 43 (counterclockwise as observed in FIG. 4) until pawl or hook 39 disengages from teeth 37 and, under the urging of spring 41, arm 31 swings open and security device 9 will disengage from the display hooks or rods so that merchandise can then be removed.

When engaged with rods 22 and 23 and/or 19 and arm 31 closed or locked, security device 9 hangs downward with arm 31 resting on the hook or hooks and cannot be slid off the end of the rods. This prevents unauthorized removal of any merchandise which is mounted on the display hooks. When the security device is removed by operating the key to open locking arm 31, the security device drops off the hooks so that merchandise can be slipped off the ends of the display hooks.

Figure 5:
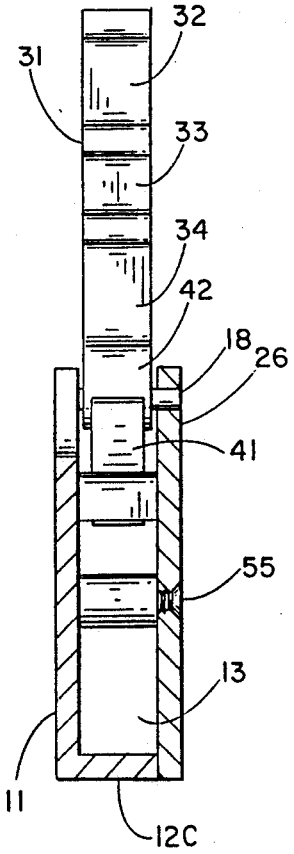
FIG. 5 is a section view of the preferred embodiment as taken along viewing line 5—5 of FIG. 1.
Figure 6:
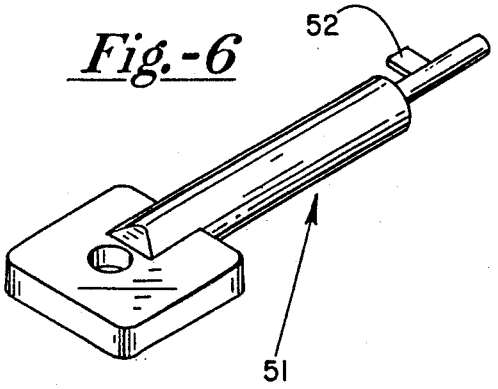
FIG. 6 is an illustration of a key used for releasing the locking arm of the preferred embodiment.

As most clearly shown in FIG. 5, arm 31 is pivotably mounted between front and back plate members 26 and 11 and its thickness or width is less than the depth of chamber 13 or the space between plate members 26 and 11. This permits arm 31 to be swung downward at least part way into chamber 13 so as to control the size of the openings or passageways for the rods formed when arm 31 is closed. For a smaller sized rod, arm 31 will be swung further into chamber 13 than for a larger size rod. Correspondingly, pawl 39 will latch onto the appropriate tooth out of the set of teeth 37 at the end of arm 31. This will ensure that the security device will work properly with a wide range of display hooks, including hooks of various rod diameters.

As a special feature, space 53 on front plate member 26 is convenient to use for attaching a tag or a label, such as a bar code label, which carries various indicia and information about the merchandise on the display hook.

I claim:

1. Merchandise display and security device comprising, in combination:

a) elongated rod means attached at an end in cantilevered fashion to a support, said rod means holding and displaying packaged merchandise.

b) rigid plate means, having parallel, spaced-apart, coextensive front and back planar plate members with top, bottom and side edges, a plurality of open-ended transversely spaced slots on the top edge of said plate members, said rod means insertable into said slots through the open end of said slots such that said rod means is orthogonal to said plate members;

c) locking arm means pivotably attached to said plate means between said plate members swingable to close the open end of said slots when said rod means is inserted into said slots such that said rod means cannot be removed through the open end of said slots; and d) means for releasably latching said locking arm means tightly against said rod means for preventing said plate means from being removed off the distal end of said rod means when said locking arm means closes off said open end of said slots.

2. A merchandise display and security device as described in claim 1, wherein said rod means comprises at least a pair of rigid, parallel, spaced-apart rod members.

3. A merchandise display and security device as described in claim 1 wherein said rod means comprises a rod member angled upward adjacent its distal end.

4. A merchandise display and security device as described in claim 1 wherein said means for releasably latching said locking arm means in the closed position, comprises:

teeth on one end of said locking arm means;

a hook member pivotably attached to said plate means for engaging said teeth;

first spring means resiliently urging said hook member into engagement with said teeth on said locking arm means when said locking arm means is in the closed position to keep said locking arm means in the closed position;

another spring means urging said locking arm means toward an open position; and key means for engaging said hook member for pivoting said hook member against the force of said first spring means to move said hook member out of engagement with said teeth on said locking arm means for releasing said locking arm means to allow it to swing to an open position.

5. A merchandise display and security device as described in claim 1 wherein said plate members have two slots.

6. A merchandise display and security device as described in claim 2 wherein said plate means has three slots, two of said slots for engaging said pair of rod members with the third slot located between said pair of slots.

7. The merchandise display and security device as described in claim 2 wherein said pair of rod members are linked together at their distal ends.

8. The merchandise display and security device as described in claim 1 further including an area on said front planar plate member for carrying a label to identify merchandise held on said display rod means.

* * * * *